US008313535B2

(12) United States Patent
Schaub et al.

(10) Patent No.: US 8,313,535 B2
(45) Date of Patent: Nov. 20, 2012

(54) METHOD FOR IMPREGNATING TEXTILES

(75) Inventors: Hartmut Schaub, Berlin (DE); Ingo Schulze, Roentgental/Zepernick (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 975 days.

(21) Appl. No.: 11/793,942

(22) PCT Filed: Oct. 19, 2005

(86) PCT No.: PCT/EP2005/055373

§ 371 (c)(1),
(2), (4) Date: Jun. 21, 2007

(87) PCT Pub. No.: WO2006/066986

PCT Pub. Date: Jun. 29, 2006

(65) Prior Publication Data

US 2008/0047076 A1 Feb. 28, 2008

(30) Foreign Application Priority Data

Dec. 22, 2004 (DE) ..... 10 2004 061 894

(51) Int. Cl.
*C11D 3/00* (2006.01)

(52) U.S. Cl. ..... 8/115.51; 252/8.6; 252/8.8; 427/389.9; 427/393.4

(58) Field of Classification Search ..... 252/8.6, 252/8.8, 8.9; 427/389.9, 393.4
See application file for complete search history.

(56) References Cited

U.S. PATENT DOCUMENTS

| | | | | |
|---|---|---|---|---|
| 2,316,057 | A | 4/1943 | Doser et al. | |
| 4,188,807 | A * | 2/1980 | Graf et al. | 68/17 R |
| 2003/0192130 | A1 | 10/2003 | Kaaret et al. | |

FOREIGN PATENT DOCUMENTS

| | | |
|---|---|---|
| AT | 395 965 | 4/1993 |
| EP | 0 548 035 | 6/1993 |
| EP | 0 913 117 | 5/1999 |

OTHER PUBLICATIONS

International Search Report PCT/EP2005/055373.

* cited by examiner

*Primary Examiner* — Doris Lee
(74) *Attorney, Agent, or Firm* — James E. Howard; Andre Pallapies

(57) ABSTRACT

A method for creating a hydrophobic effect of textiles in a washing machine. Hydrophobic agents dissolved in the washing liquid are contacted with the textiles during a treatment process. The tub is filled with an amount of water which is proportioned and which is heated to a minimum temperature in the tub while the textiles are soaked. The hydrophobic agent is flushed from the detergent storage chamber into the lye container by means of water and forms a washing liquid along with the water. The textiles are contacted with the washing liquid and are treated for a maximum of 30 minutes. The washing liquid is removed from the textiles and the washing liquid container by spin-drying without rinsing.

30 Claims, 1 Drawing Sheet

METHOD FOR IMPREGNATING TEXTILES

The invention relates to a method for producing a hydrophobic effect on textiles in a domestic washing machine comprising devices for heating a washing liquid located in a tub and for controlling a washing process as well as a detergent storage chamber for supplying an individual dose of a liquid additional laundry care product in which method hydrophobic active substances dissolved in the washing liquid are brought in contact with the textiles during a treatment process similar to a washing process.

BACKGROUND OF THE INVENTION

Functional textiles such as outer clothing worn for protection against moisture from the air gradually lose their water-repelling property, their impregnation, during use. This property can be restored by applying a hydrophobic substance to the textile fibers. In general, this textile treatment is carried out in an industrial laundry or a cleaning business. However, there is an increasing desire for such treatments to be carried out in a domestic washing machine.

Hydrophobizing agents suitable for use in domestic washing machines for impregnating textiles are therefore being provided in the relevant trade. Such agents predominantly consist of fluorocarbon resins or paraffin-containing agents. The impregnation is then conducted in a known manner in a standard washing process in a so-called long wash that includes a relatively large amount of washing liquid per kg of laundry is used. A recommended dose of hydrophobic active substance is poured into the main wash compartment of a detergent flushing-in device before the beginning of this standard washing process and is supplied together with cold fresh water to the tub of the washing machine. The impregnating solution is brought in contact with the laundry during movement of the laundry by rotating the laundry drum whilst it is heated in the tub by means of a heating device. The duration of this treatment is predefined by the program of the washing machine controller which, among other things, is determined by reaching the predetermined temperature of the impregnating solution. At the end of the washing process, the laundry is rinsed several times so that the quantity of impregnating agent absorbed on the textile fibers of the laundry is reduced again. Thus, the hydrophobic effect which can be achieved by the known method is relatively small.

SUMMARY OF THE INVENTION

The object of the invention is to provide a method which can be used in a domestic washing machine and in which the attainable hydrophobic effect is significantly higher compared to the prior art.

According to the invention, this object is achieved by the features specified in the claims in such a manner that the tub is filled with a quantity of water which is proportioned for a short wash, i.e. the ratio of the weight of dry textile to the weight of the water is greater than 1:8, which is heated whilst wetting the textiles in the tub to at least that temperature which is recommended by the textile manufacturer as the treatment temperature (e.g. 40° C.), a predetermined quantity of hydrophobic active substance is flushed into the tub from the detergent storage chamber by means of water and together with the water forms the washing liquid, that the textiles are the brought into contact with the washing liquid for the first time and treated for a maximum duration of 30 min and the washing liquid is then removed from the textiles and from the tub by spinning without rinsing.

As a result of the entirety of the preceding measures, the hydrophobic effect on the textiles is significantly increased. The high concentration of active substance in the washing liquid improves the absorption behavior of the active substance and prevents an unnecessarily large consumption of active substance compared with long washes. The incorporation of the active substance into the already heated washing solution prevents spot formation on the textiles and further improves the absorption behavior of the active substance on the fibers. Good results are achieved with a treatment time of less than 30 min. Longer dwell times waste energy without additional benefit. Dispensing with subsequent rinsing processes avoids the risk of dilution or washing away the active substance from the textile fibers.

Advantageous further developments of the method according to the invention are described in the dependent claims which can be used individually or in any combination with one another.

BRIEF DESCRIPTION OF THE DRAWINGS

The invention is explained hereinafter with reference to an exemplary embodiment. In the figures.

DETAILED DESCRIPTION OF THE EXEMPLARY EMBODIMENTS OF THE PRESENT INVENTION

Figure 1:
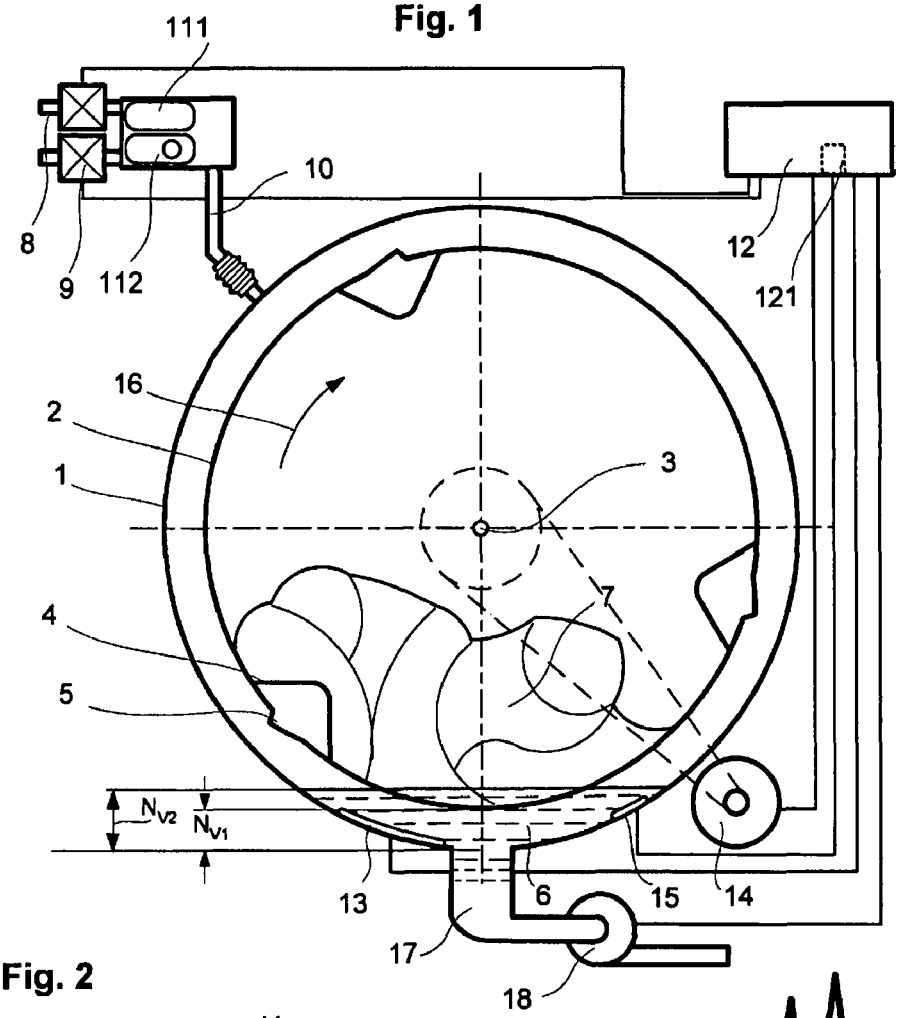
FIG. 1 is a schematic diagram of a washing machine comprising a tub and a laundry drum mounted therein for receiving textiles and FIG. 2 is a diagram for the time sequence of the method according to the invention.

The tub 1 in FIG. 1 contains a laundry drum 2 mounted about a horizontal axis 3 therein, with actuators 4 for the laundry 7 consisting of textiles. The actuators 4 have scoop devices whereby washing liquid 6 located at the bottom of the tub 1 is scooped in the direction of the arrow 16 during rotation of the laundry drum 2, raised to a level above the laundry 7 and can rained down onto the laundry 7 from above. The wetting and flooding of the laundry 7 is thereby accelerated. An electric motor 14 which introduces its rotary movement into the laundry drum 2 via a belt drive is used to rotate the laundry drum 2.

A heating device 13 used to heat the washing liquid is located at the bottom of the tub 1. This washing liquid 6 passes into the tub 1 by actuating one of the solenoid valves 8 or 9 and consists either of only water or of a mixture of water and additional laundry care agent. The detergent flushing-in device 11 has two chambers 111 and 112 through which fresh water flows when the allocated solenoid valve is opened. Additional laundry care agents located in the chambers are then transferred by the water through the pipe 10 from the detergent flushing-in device 11 into the tub 1. Washing liquid 6 located at the bottom of the tub 1 can be conveyed outside by means of the drain pipe 17 and the pump 18 in a manner not shown here in detail.

All switchable or controllable devices such as the solenoid valves 8 and 9, the heating device 13, the drum drive motor 14 and the discharge pump 18 are switched or controlled by the control device 12 of the washing machine. A temperature sensor 15 which transmits measurement signals via the message line to an evaluation device 121 in the control device 12 is also used to measure the temperature of the washing liquid 6.

Figure 2:
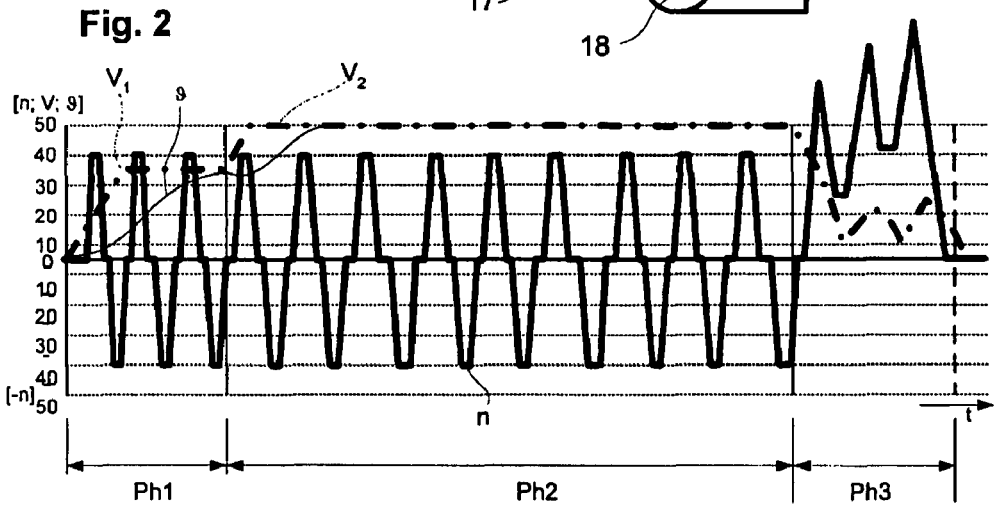

According to the invention, the washing machine shown in FIG. 1 is operated, for example, as shown in FIG. 2. For this purpose, the solenoid valve 8 is initially opened to fill the tub 1 with water via the detergent chamber 111, which is empty in this example, and the pipe 10. The amount of water poured in during this first phase Ph1 is appropriate to the laundry items 7 stored in the laundry drum 1 minus a quantity which is to be supplied subsequently together with the hydrophobic active substance. This quantity first runs into the tub 1 and forms a level $N_{V1}$ at its bottom which is already in contact with the laundry drum 1. In this way, the scooping devices 5 on the laundry drum are in a position to receive water from the tub 1 during the rotation of the drum which has already started, transport this water upwards and rain it down over the laundry 7. The rotation of the drum is shown by the bold line n in the diagram. In order that the laundry items do not shrink, the drum 2 is driven in reversing mode. This operating mode is merely shown schematically here and can be varied in an arbitrary manner to promote the wetting and the flooding of the laundry.

At the end of phase Ph1 in which the water in the tub is suitably heated to a maximum of 40° C. by the heating device 13 according to the thin line θ in the diagram (this can be that temperature which is recommended as the treatment temperature by the textile manufacturer), the solenoid valve 9 opens. The water flowing in as a result entrains stored hydrophobic active substance from the detergent chamber 112 and now flows as highly concentrated washing liquid into the tub 1. There this washing liquid mixes with the heated water already provided so that the concentration of the washing liquid drops to a tolerable level for the laundry 7 so that there is no longer any risk of staining with high active substance concentrations which would otherwise be possible. During phase Ph2 which now begins, the drum is driven further and vigorously combs with its scooping devices 5 through the washing liquid 6 which is now at a higher level (level $N_{V2}$). As a result, the laundry is now flood intensively with hydrophobic washing liquid, for example, for 20 min.

At the end of phase Ph2, namely in phase Ph3, the drum movement initially stops and the drain pump 18 begins to operate. As result, the free washing liquid located in the tub 1 is sucked rapidly through the drain pipe by the pump 18 and removed. Very soon after the pump begins to operate, the drum drive is then set to spinning mode. In the diagram shown the high speeds are shown as compressed for reasons of space. In any case, three spinning pulses each having increasing final speeds can be identified whereby increasing amount of bound washing liquid is expelled from the laundry. In the last spinning interval the final spinning speed can reach 800 rpm. In this case, the otherwise usual rinsing with clear water is specifically omitted so that as much hydrophobic substance as possible which has been absorbed on the laundry fibers is retained there. The drain pump 18 continues operating during the spinning interval so that the washing liquid expelled from the laundry is rapidly removed.

The invention claimed is:

1. A method for producing a hydrophobic effect on textiles in a domestic washing machine comprising a tub, a drum mounted in the tub, a heating device for heating a washing liquid located in the tub, a controller for controlling a washing process, and a detergent storage chamber for supplying an individual dose of a liquid additional laundry care product in which method hydrophobic active substances dissolved in the washing liquid are brought in contact with the textiles during a treatment process, the method comprising:

filling the tub with a quantity of water which is proportioned for a short wash, wherein a ratio of a weight of dry textile to a weight of the water is greater than 1:8;

heating the water while wetting the textiles in the tub to at least that temperature which is recommended by a textile manufacturer as a treatment temperature;

flushing a predetermined quantity of hydrophobic active substance into the tub from the detergent storage chamber by means of water and together with the water forming the washing liquid;

bringing the textiles into contact with the washing liquid for a first time and treating the textiles for a maximum duration of 30 min; and removing the washing liquid from the textiles and from the tub by spinning the drum in the tub without rinsing.

2. The method according to claim 1, wherein the predetermined quantity of active substance is set to a concentration of 30 g maximum per liter of water.

3. The method according to claim 1, wherein the ratio is at least 1:6.

4. The method of claim 1, wherein the treatment temperature is 40° C.

5. The method of claim 1, wherein the spinning without rinsing includes three spinning pulses each having an increasing final speed.

6. The method of claim 1, wherein the maximum duration is equal to or less than 20 minutes.

7. The method according to claim 1, wherein the predetermined quantity of active substance is set to a concentration of 30 g maximum per liter of water, and wherein the maximum duration is equal to or less than 20 minutes.

8. The method according to claim 1, wherein the predetermined quantity of active substance is set to a concentration of 30 g maximum per liter of water, and wherein the ratio is at least 1:6.

9. The method according to claim 8, wherein the maximum duration is equal to or less than 20 minutes.

10. A method for producing a hydrophobic effect on textiles in a domestic washing machine comprising a tub, a drum mounted in the tub, a heating device for heating a washing liquid located in the tub, a controller for controlling a washing process, and a detergent storage chamber for supplying an individual dose of a liquid additional laundry care product in which method hydrophobic active substances dissolved in the washing liquid are brought in contact with the textiles during a treatment process, the method comprising:

filling the tub with a predetermined quantity of water in which a ratio of a weight of dry textile to a weight of the predetermined quantity of water is greater than 1:8;

heating the predetermined quantity of water to a predetermined treatment temperature for the textiles while wetting the textiles in the tub;

after the predetermined quantity of water is heated to the predetermined treatment temperature, flushing the washing liquid into the predetermined quantity of water in the tub from the detergent storage chamber, the washing liquid including a predetermined quantity of hydrophobic active substance and water;

bringing the textiles into contact with the washing liquid for a first time and treating the textiles with the washing liquid a duration of equal to or less than 30 minutes; and removing the washing liquid and the predetermined quantity of water from the textiles and from the tub by operating the drain pump and spinning the drum in the tub without rinsing.

11. The method of claim 10, wherein the washing liquid has a concentration of 30 g maximum of the predetermined quantity of active substance per liter of water.

12. The method of claim 10, wherein the ratio of the weight of dry textile to the weight of the water is at least 1:6.

13. The method of claim 10, wherein the treatment temperature is at least 40° C.

14. The method of claim 10, wherein the spinning without rinsing includes three spinning pulses each having an increasing final speed.

15. The method of claim 10, wherein the treating the textiles with the washing liquid has a duration of equal to or less than 20 minutes.

16. The method of claim 10, wherein the washing liquid has a concentration of 30 g maximum of the predetermined quantity of active substance per liter of water, and wherein the treating the textiles with the washing liquid has a duration of equal to or less than 20 minutes.

17. The method of claim 10, wherein the predetermined treatment temperature of the predetermined quantity of water is equal to or less than 40° C.

18. The method of claim 17, wherein the predetermined treatment temperature of the predetermined quantity of water is 40° C.

19. The method of claim 10, wherein the washing liquid has a concentration of 30 g maximum of the predetermined quantity of active substance per liter of water, and wherein the ratio of the weight of dry textile to the weight of the water is at least 1:6.

20. The method of claim 19, wherein the treating the textiles with the washing liquid has a duration of equal to or less than 20 minutes.

21. A method for producing a hydrophobic effect on textiles in a domestic washing machine comprising a tub, a drum mounted in the tub, a heating device for heating a washing liquid located in the tub, a controller for controlling a washing process, and a detergent storage chamber for supplying an individual dose of a liquid additional laundry care product in which method hydrophobic active substances dissolved in the washing liquid are brought in contact with the textiles during a treatment process, the method comprising:

a first phase including filling the tub with a predetermined quantity of water in which a ratio of a weight of dry textile to a weight of the predetermined quantity of water is greater than 1:8, and heating the predetermined quantity of water to a predetermined treatment temperature for the textiles while wetting the textiles in the tub;

a second phase following the first phase, the second phase including flushing the washing liquid into the predetermined quantity of water in the tub from the detergent storage chamber, the washing liquid including a predetermined quantity of hydrophobic active substance and water, bringing the textiles into contact with the washing liquid for a first time, and treating the textiles with the washing liquid for a duration of equal to or less than 30 minutes; and a third phase following the second phase, the third phase including removing the washing liquid and the predetermined quantity of water from the textiles and from the tub by operating the drain pump and spinning the drum in the tub without an intervening rinsing process.

22. The method of claim 21, wherein the washing liquid has a concentration of 30 g maximum of the predetermined quantity of active substance per liter of water.

23. The method of claim 21, wherein the ratio of the weight of dry textile to the weight of the water is at least 1:6.

24. The method of claim 21, wherein the treatment temperature is 40° C.

25. The method of claim 21, wherein the treating the textiles with the washing liquid has a duration of equal to or less than 20 minutes.

26. The method of claim 21, wherein the washing liquid has a concentration of 30 g maximum of the predetermined quantity of active substance per liter of water, and wherein the treating the textiles with the washing liquid has a duration of equal to or less than 20 minutes.

27. The method of claim 21, wherein the predetermined treatment temperature of the predetermined quantity of water is equal to or less than 40° C.

28. The method of claim 27, wherein the predetermined treatment temperature of the predetermined quantity of water is 40° C.

29. The method of claim 21, wherein the washing liquid has a concentration of 30 g maximum of the predetermined quantity of active substance per liter of water, and wherein the ratio of the weight of dry textile to the weight of the water is at least 1:6.

30. The method of claim 29, wherein the treating the textiles with the washing liquid has a duration of equal to or less than 20 minutes.

* * * * *